US011808164B1

(12) United States Patent
West et al.

(10) Patent No.: US 11,808,164 B1
(45) Date of Patent: Nov. 7, 2023

(54) SIMULTANEOUSLY ASSEMBLING ROTOR BLADES FROM A GAS TURBINE ENGINE ROTOR DISK

(71) Applicant: Pratt & Whitney Canada Corp., Longueuil (CA)

(72) Inventors: Robert West, Mississauga (CA); Howard Mah, Mississauga (CA); Sowriraja Krishnasamy, Mississauga (CA); Dean-Andrew Michalagas, Etobicoke (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 17/891,789

(22) Filed: Aug. 19, 2022

(51) Int. Cl.
*F01D 25/28* (2006.01)
*F01D 5/30* (2006.01)

(52) U.S. Cl.
CPC ..... *F01D 25/285* (2013.01); *F01D 5/3007* (2013.01); *F05D 2230/60* (2013.01)

(58) Field of Classification Search
CPC .. F01D 25/285; F01D 5/3007; F05D 2230/60; F05D 2230/68
See application file for complete search history.

(56) References Cited

U.S. PATENT DOCUMENTS

| | | | | |
|---|---|---|---|---|
| 7,694,417 | B2 * | 4/2010 | Crain | F01D 5/3007 29/466 |
| 9,328,621 | B2 * | 5/2016 | Lecuyer | B23P 19/10 |
| 10,760,434 | B2 | 9/2020 | Kolvick | |
| 2008/0193293 | A1 * | 8/2008 | Greenberg | F01D 25/285 416/193 A |

* cited by examiner

*Primary Examiner* — David P Bryant
*Assistant Examiner* — Christine Bersabal
(74) *Attorney, Agent, or Firm* — Getz Balich LLC

(57) ABSTRACT

A method is provided for assembling a rotor of a gas turbine engine. During this method, a rotor disk is provided that includes an axis and a plurality of slots arranged circumferentially about the axis in an array. A plurality of rotor blades are provided that include a plurality of airfoils and a plurality of attachments. Each of the rotor blades includes a respective one of the airfoils and a respective one of the attachments. Each of the attachments is inserted partially into a respective one of the slots. The rotor blades are rested on top of a blade support structure. The blade support structure is lowered axially downward along the rotor disk to simultaneously seat the attachments into the slots.

19 Claims, 13 Drawing Sheets

SIMULTANEOUSLY ASSEMBLING ROTOR BLADES FROM A GAS TURBINE ENGINE ROTOR DISK

TECHNICAL FIELD

This disclosure relates generally to a gas turbine engine and, more particularly, to methods and tools for assembling a bladed rotor for the gas turbine engine.

BACKGROUND INFORMATION

A gas turbine engine includes multiple bladed rotors such as, but not limited to, a fan rotor, a compressor rotor and a turbine rotor. Each bladed rotor may include a rotor disk and a plurality of rotor blades mechanically attached to the rotor disk. The bladed rotor may also include feather seals for sealing inter-platform gaps between circumferentially neighboring rotor blades. Various methods and tools are known in the art for assembling a bladed rotor. While these known assembly methods and tools have various advantages, there is still room in the art for improvement.

SUMMARY

According to an aspect of the present disclosure, a method is provided for assembling a rotor of a gas turbine engine. During this method, a rotor disk is provided that includes an axis and a plurality of slots arranged circumferentially about the axis in an array. A plurality of rotor blades are provided that include a plurality of airfoils and a plurality of attachments. Each of the rotor blades includes a respective one of the airfoils and a respective one of the attachments. Each of the attachments is inserted partially into a respective one of the slots. The rotor blades are rested on top of a blade support structure. The blade support structure is lowered axially downward along the rotor disk to simultaneously seat the attachments into the slots.

According to another aspect of the present disclosure, another method is provided for assembling a rotor of a gas turbine engine. During this method, a rotor disk, a plurality of rotor blades and a plurality of seal elements are provided. The rotor disk includes an axis and a plurality of slots arranged circumferentially about the axis in an array. The rotor blades include a plurality of airfoils and a plurality of attachments. Each of the rotor blades includes a respective one of the airfoils and a respective one of the attachments. Each of the attachments is inserted partially into a respective one of the slots. Each of the seal elements is arranged between a respective circumferentially neighboring pair of the rotor blades. The attachments are simultaneously seated into the slots using a force of gravity alone to push the attachments into the slots.

According to still another aspect of the present disclosure, a fixture is provided for assembling a rotor of a gas turbine engine. This assembly fixture includes a disk support structure and a blade support structure. The disk support structure is configured to support a rotor disk of the rotor during assembly of the rotor. The disk support structure includes a base, a radial locator and an axial locator circumscribing the radial locator. The radial locator projects axially along an axis out from a first side of the base. The radial locator is configured to radially locate and engage the rotor disk on the disk support structure. The axial locator projects axially along the axis out from the first side of the base. The axial locator is configured to axially locate and engage the rotor disk on the disk support structure. The blade support structure is configured to support a plurality of rotor blades of the rotor during the assembly of the rotor. The blade support structure circumscribes and is slidable against an outer periphery of the disk support structure. The blade support structure extends axially along the axis to a planar annular surface configured to axially locate and engage the rotor blades while attachments of the rotor blades are seated in slots in the rotor disk.

The assembly fixture may also include a guide connected to the disk support structure and projecting radially into a slot in the blade support structure. The slot may extend within the blade support structure along a longitudinal trajectory. A first section of the longitudinal trajectory may have an axial component and a circumferential component. A second section of the longitudinal trajectory may have a circumferential component.

The assembly fixture may also include a lock configured to rotatably fix the blade support structure to the disk support structure.

The rotor blades may also include a plurality of platforms. Each of the rotor blades may also include a respective one of the platforms. Axial edges of the platforms may define a reference plane while the attachments are seated into the slots.

The method may also include resting the axial edges of the platforms on top of a planar annular surface of a blade support structure as the attachments are seated into the slots.

Gravity may maintain the rotor blades resting on top of the blade support structure as the blade support structure is lowered axially downward along the rotor disk.

The method may also include: providing a plurality of seal elements; and inserting each of the seal elements into a respective cavity formed by and between a respective circumferentially neighboring pair of the rotor blades.

Each of the seal elements may be inserted into the respective cavity prior to the lowering of the blade support structure.

Each of the seal elements may be inserted into the respective cavity subsequent to the inserting of each of the attachments partially into the respective one of the slots.

The seal elements may include a first seal element. The first seal element may include a base and a plurality of tabs connected to and projecting out from the base.

Each of the tabs may project radially inward from the base to a distal tab end.

The rotor disk may also include a plurality of lugs. Each of the slots may be formed by and between a respective circumferentially neighboring pair of the lugs. A first of the lugs may project radially outward to a distal lug end including a first end surface and a second end surface recessed radially inward from the first end surface. Subsequent to the attachments being simultaneously seated into the slots, a first of the tabs may be operable to radially engage the first end surface and a second of the tabs may be operable to radially engage the second end surface.

The rotor blades may be rested on a planar annular surface of the blade support structure.

The rotor blades may also include a plurality of platforms. Each of the rotor blades may include a respective one of the platforms. The resting of the rotor blades may include resting axial edges of the platforms on top of the planar annular surface.

The method may also include rotating the blade support structure about the axis while the blade support structure is lowered axially downward along the rotor disk.

The method may also include disposing the rotor disk on top of a disk support structure. The blade support structure may be mated with and circumscribe the disk support structure.

The method may also include lifting the rotor off of an assembly fixture. The rotor may include the rotor disk and the rotor blades. The assembly fixture may include the blade support structure.

The rotor disk may include a turbine disk of the gas turbine engine. The rotor blades may include a plurality of turbine blades of the gas turbine engine.

The present disclosure may include any one or more of the individual features disclosed above and/or below alone or in any combination thereof.

The foregoing features and the operation of the invention will become more apparent in light of the following description and the accompanying drawings.

DETAILED DESCRIPTION

Figure 1:
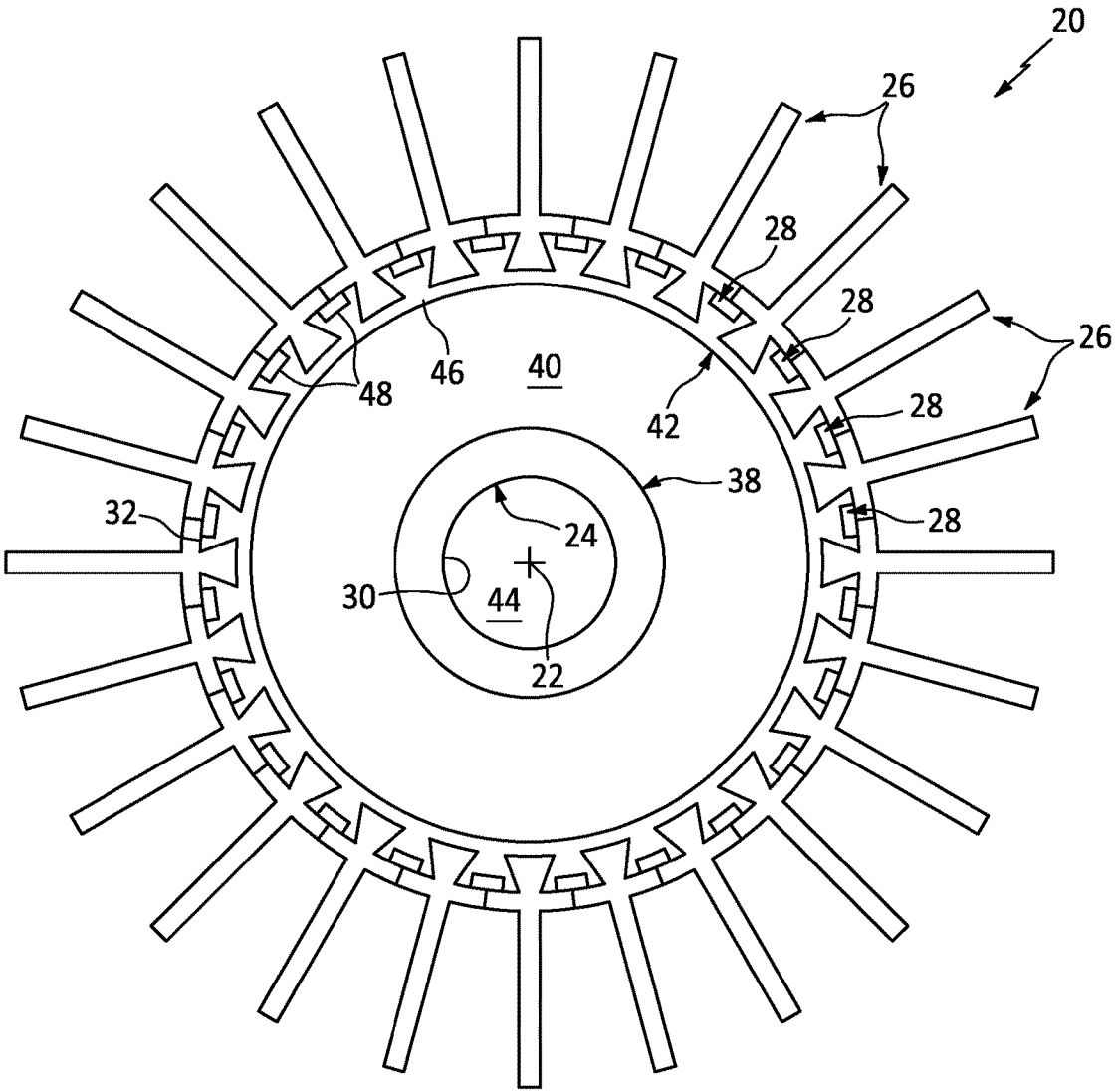
FIG. 1 is a schematic illustration of a bladed rotor for a gas turbine engine.

FIG. 1 schematically illustrates a bladed rotor 20 for a gas turbine engine. This bladed rotor 20 is rotatable about a rotational axis 22, which rotational axis 22 is also an axial centerline of the bladed rotor 20. The bladed rotor 20 of FIG. 1 includes a rotor disk 24 and a plurality of rotor blades 26 attached to and arranged circumferentially around the rotor disk 24 in a circular array. The bladed rotor 20 of FIG. 1 also includes a plurality of seal elements 28; e.g., feather seals.

Figure 2:
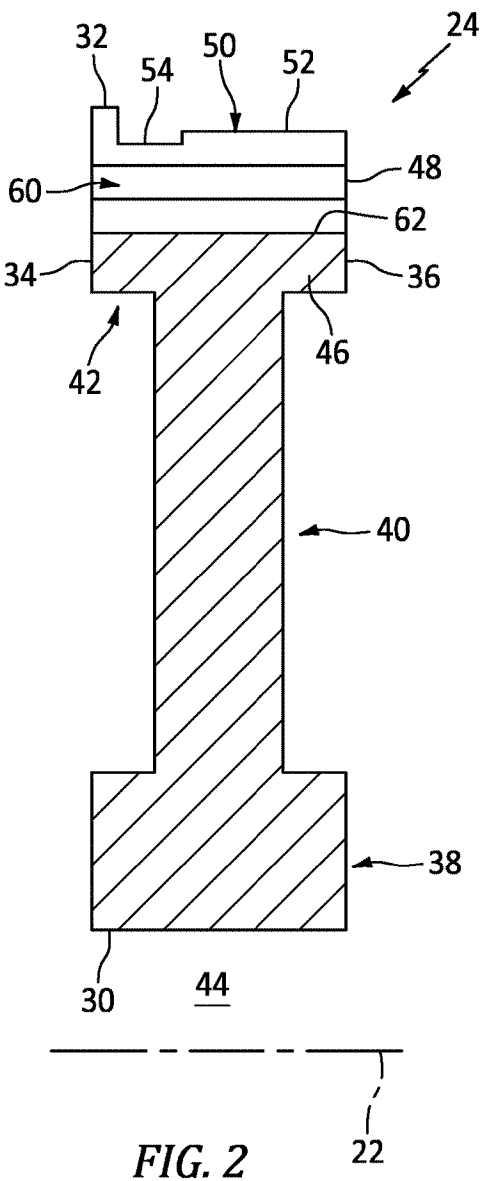
FIG. 2 is a partial side sectional schematic illustration of a rotor disk.

Referring to FIG. 2, the rotor disk 24 extends radially between and to a radial inner side 30 of the rotor disk 24 and a radial outer side 32 of the rotor disk 24. The rotor disk 24 extends axially along the axis 22 between and to an axial first (e.g., upstream) side 34 of the rotor disk 24 and an axial second (e.g., downstream) side 36 of the rotor disk 24. Referring to FIG. 1, the rotor disk 24 extends circumferentially around the axis 22 providing the rotor disk 24 with an annular body. The rotor disk 24 includes a disk hub 38, a disk web 40 and a disk rim 42.

The disk hub 38 is disposed at the disk inner side 30. The disk hub 38 forms a bore 44 through the rotor disk 24 along the axis 22 between the disk first side 34 and the disk second side 36; see also FIG. 2.

The disk web 40 is disposed radially between and connected to (e.g., formed integral with) the disk hub 38 and the disk rim 42. The disk web 40 of FIG. 1 extends radially out from the disk hub 38 to the disk rim 42.

Figure 3:
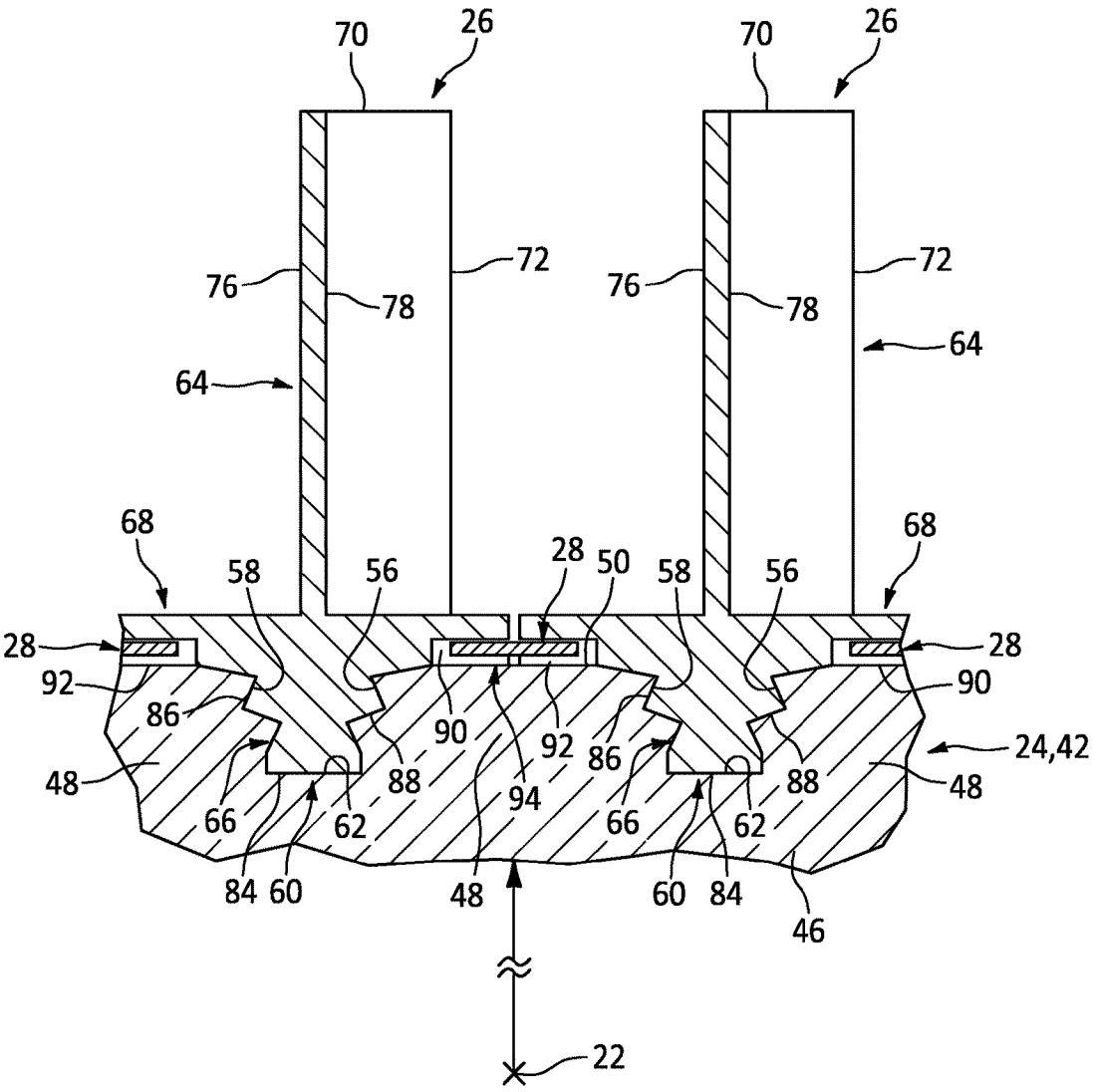
FIG. 3 is a partial cross-sectional schematic illustration of the bladed rotor.

The disk rim 42 is disposed at the disk outer side 32. The disk rim 42 forms a radial outer periphery of the rotor disk 24. The disk rim 42 includes an annular rim base 46 and a plurality of rotor disk lugs 48 connected to (e.g., formed integral with) the rim base 46. The disk lugs 48 are arranged circumferentially about the axis 22 in a circular array. Referring to FIG. 2, each of the disk lugs 48 projects radially out from the rim base 46 to a radial outer distal lug end 50 of the respective disk lug 48. This distal lug end 50 may have a stepped geometry. The distal lug end 50 of FIG. 2, for example, includes a first end surface 52 and a second end surface 54 recessed radially inward from the first end surface 52. Each of the disk lugs 48 extends axially along the axis 22 between and to the disk first side 34 and the disk second side 36. Referring to FIG. 3, each of the disk lugs 48 extends circumferentially about the axis 22 between and to a circumferential first side 56 of the respective disk lug 48 and a circumferential second side 58 of the respective disk lug 48.

The disk lugs 48 are configured to provide the rotor disk 24 with a plurality of retaining slots 60. Each of the retaining slots 60 is formed by and extends circumferentially between a respective circumferentially neighboring (e.g., adjacent) pair of the disk lugs 48. Each retaining slot 60 of FIG. 3, for example, extends circumferentially within the rotor disk 24 and its disk rim 42 between and to the lug first side 56 of a first of the circumferentially neighboring pair of the disk lugs 48 and the lug second side 58 of a second of the circumferentially neighboring pair of the disk lugs 48. Referring to FIG. 2, each retaining slot 60 projects radially into the rotor disk 24 and its disk rim 42 from the disk outer side 32 to a bottom 62 of the respective retaining slot 60. Each of the retaining slots 60 may extend axially through the rotor disk 24 and its disk rim 42 along the axis 22 between and to the disk first side 34 and the disk second side 36. Examples of the retaining slots 60 include, but are not limited to, a firtree slot and a dovetail slot.

Figure 4:
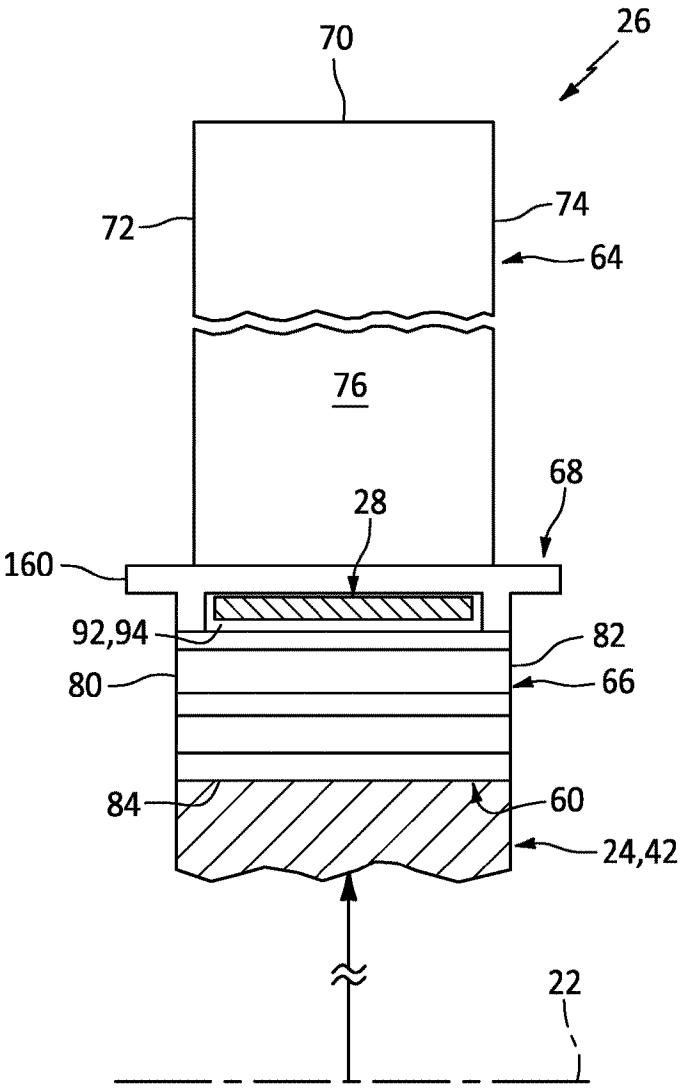
FIG. 4 is a partial side sectional schematic illustration of the bladed rotor.

Referring to FIG. 4, each of the rotor blades 26 includes a blade airfoil 64 and a blade attachment 66; e.g., a blade root. Each of the rotor blades 26 may also include a blade platform 68 radially between and connected to (e.g., formed integral with) the blade airfoil 64 and the blade attachment 66.

The blade airfoil 64 projects spanwise along a span line (e.g., radially away from the axis 22) from the blade platform 68 to a (e.g., unshrouded) tip 70 of the blade airfoil 64. The blade airfoil 64 extends chordwise along a chord line (e.g., generally axially along the axis 22) between and to a leading edge 72 of the blade airfoil 64 and a trailing edge 74 of the blade airfoil 64. Referring to FIG. 3, the blade airfoil 64 extends laterally between and to a first (e.g., concave, pressure) side 76 of the blade airfoil 64 and a second (e.g., convex, suction) side 78 of the blade airfoil 64. Referring to FIGS. 3 and 4, the airfoil first side 76 and the airfoil second side 78 each extend chordwise to and meet at the airfoil leading edge 72 and the airfoil trailing edge 74. The airfoil first side 76 and the airfoil second side 78 also extend spanwise from the blade platform 68 to and may meet at the airfoil tip 70.

The blade attachment 66 of FIG. 4 extends axially along the axis 22 between and to an axial first (e.g., upstream) end 80 of the blade attachment 66 and an axial second (e.g., downstream) end 82 of the blade attachment 66. The blade attachment 66 projects radially inward towards the axis 22 from the blade platform 68 to a radial inner distal attachment end 84 of the blade attachment 66. Referring to FIG. 3, the blade attachment 66 extends circumferentially between and to a circumferential first side 86 of the blade attachment 66 and a circumferential second side 88 of the blade attachment 66. The attachment first side 86 and the attachment second side 88 are contoured to mate with contours of a respective one of the retaining slots 60. The blade attachment 66, for example, may be configured as a blade root such as, but not limited to, a firtree root or a dovetail root. With such a configuration, each blade attachment 66 and its blade root may be seated within the respective retaining slot 60 to mount the respective rotor blade 26 to the rotor disk 24. It should be noted however, while the blade attachment 66 may consist of (e.g., only include) the blade root, it is contemplated the blade attachment 66 may also include a neck between the blade root and the blade platform 68 in other embodiments.

Referring to FIG. 3, the blade attachment 66 includes one or more pockets 90 and 92. The first pocket 90 is disposed on the attachment second side 88. The second pocket 92 is disposed on the attachment first side 86. Each of these pockets 90 and 92 projects circumferentially into the blade attachment 66 from the respective attachment side 88, 86 to a distal pocket end. Each of the pockets 90 and 92 extends radially into the rotor blade 26 to a radial outer pocket side; e.g., formed by a radial inner side of the blade platform 68. Referring to FIG. 4, each of the pockets 90 and 92 extends axially within the blade attachment 66 between and to an axial first pocket end and an axial second pocket end.

Figure 5B:
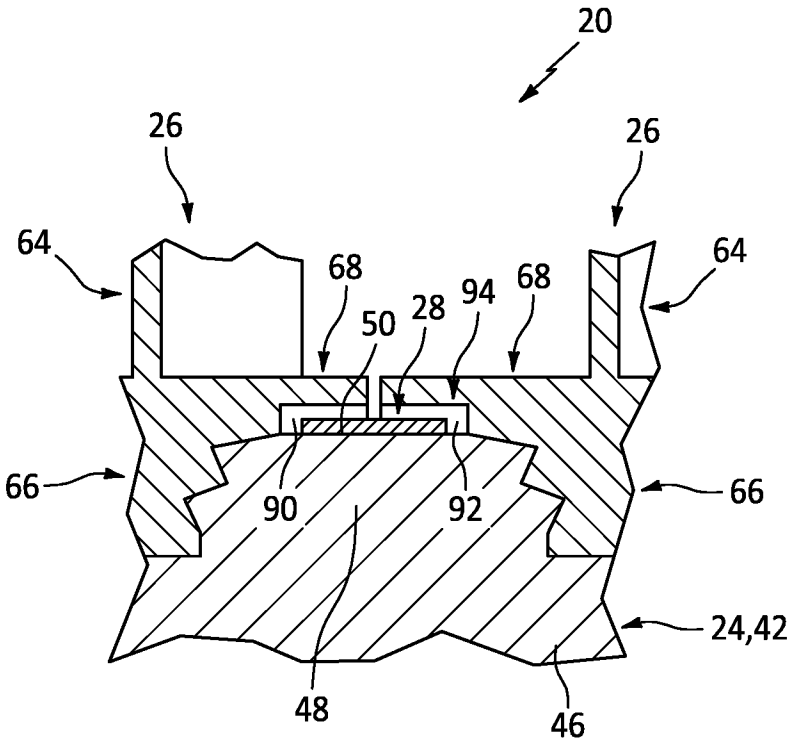
FIG. 5B is a partial side sectional schematic illustration of the bladed rotor with a seal element at a nonoperational position.
Figure 5A:
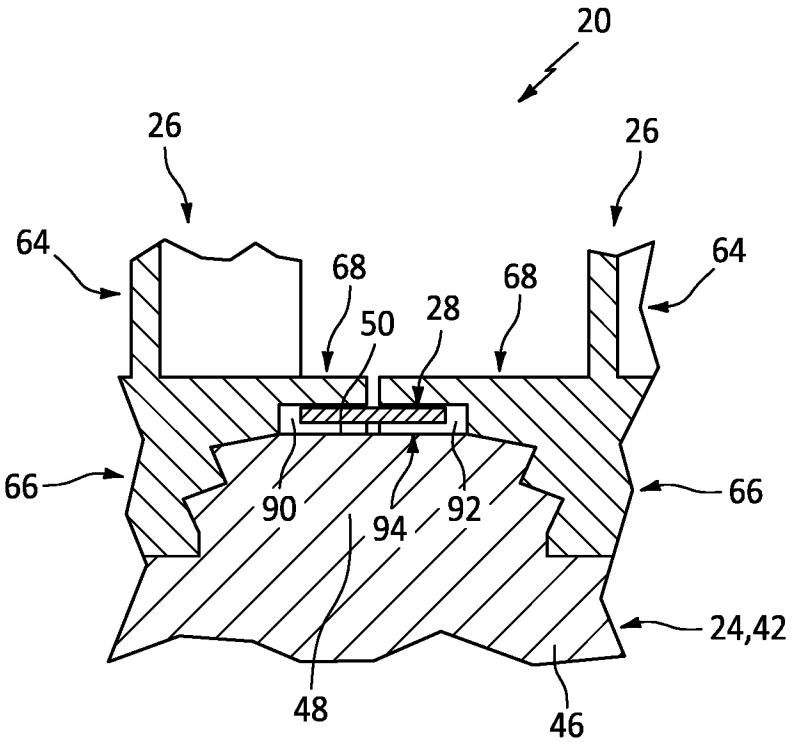
FIG. 5A is a partial side sectional schematic illustration of the bladed rotor with a seal element at an operational position.

Referring to FIGS. 3 and 4, each of the seal elements 28 is disposed in a seal element cavity 94 formed by and circumferentially between a respective circumferentially neighboring pair of the rotor blades 26. This cavity 94 may include the first pocket 90 in a first of the circumferentially neighboring pair of the rotor blades 26 and the second pocket 92 in a second of the circumferentially neighboring pair of the rotor blades 26. Referring to FIG. 5A, during gas turbine engine operation and/or while the rotor disk 24 is rotating about its axis 22, each seal element 28 may be forced radially outward and radially engage (e.g., contact) undersides of the respective blade platforms 68. Each seal element 28 may thereby seal a circumferential gap between a respective circumferentially neighboring pair of the blade platforms 68. However, referring to FIG. 5B, each seal element 28 may rest against the distal lug end 50 of a respective disk lug 48 when the gas turbine engine is nonoperational and/or while the rotor disk 24 is stationary.

Figure 6:
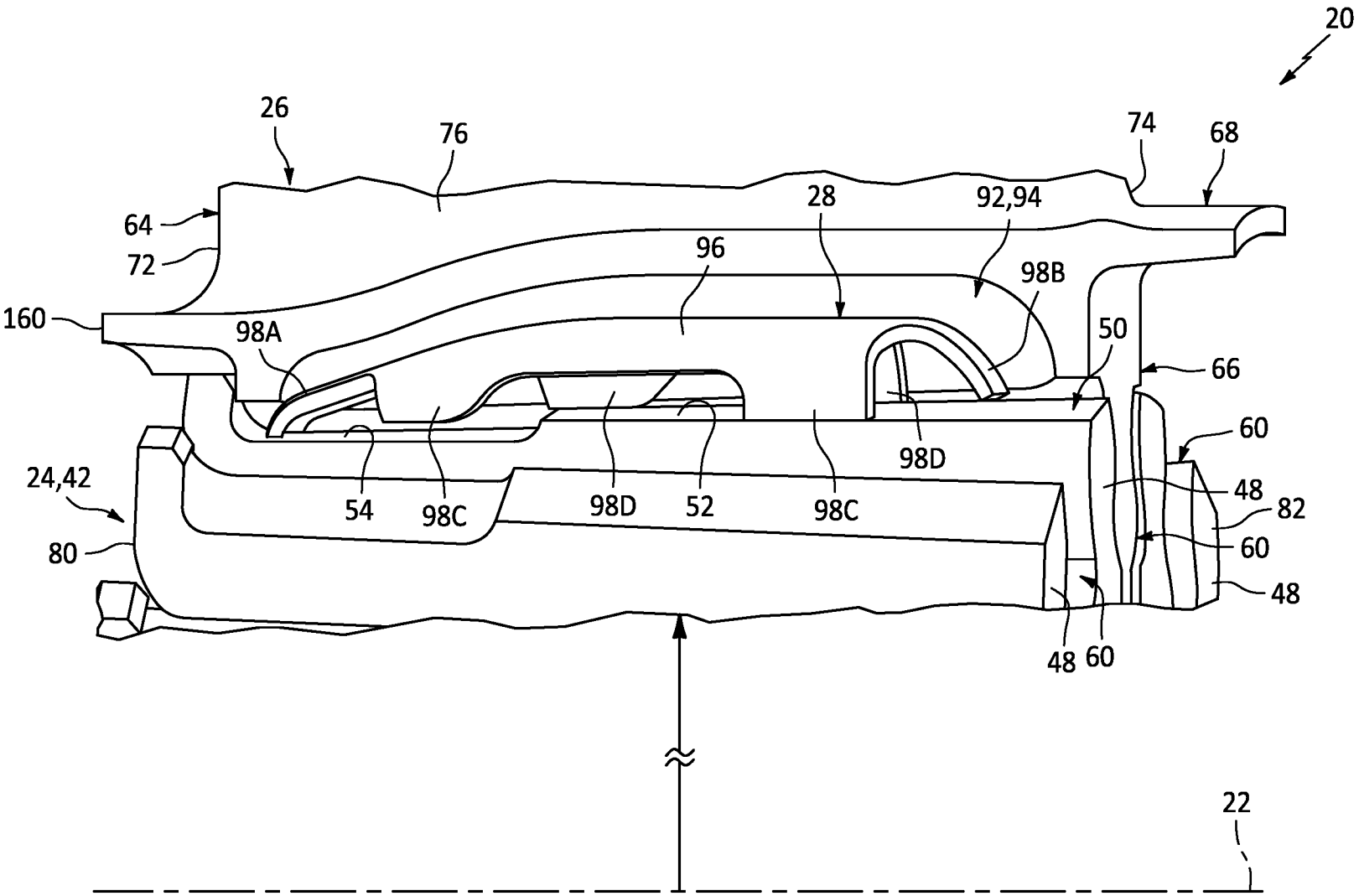
FIG. 6 is a partial perspective illustration of the bladed rotor, where the bladed rotor is shown with a single rotor blade and a single seal element for ease of illustration.

Referring to FIG. 6, each of the seal elements 28 may include an element base 96 and one or more element tabs 98 (e.g., 98A-D). Each of the element tabs 98 is connected to (e.g., formed integral with) the element base 96. Each of the element tabs 98 projects (e.g., radially inward towards the axis 22) out from the element base 96 to a distal tab end of the respective element tab 98. The first end tab 98A may be arranged at an axial first (e.g., upstream) end of the respective seal element 28. The second end tab 98B may be arranged at an axial second (e.g., downstream) end of the respective seal element 28 that is axially opposite the element first end. The first side tab(s) 98C are arranged along a circumferential first side of the respective seal element 28. The second side tab(s) 98D are arranged along a circumferential second side of the respective seal element 28. The element tabs 98 may thereby provide each seal element 28 with a bumpy, undulating radial inner geometry. Furthermore, while the rotor disk 24 is stationary, one or more of the element tabs 98 (e.g., 98B, 98C, 98D) may radially engage (e.g., contact) the respective first end surface 52 and one or more of the element tabs 98 (e.g., 98A, 98C, 98D) may radially engage the respective second end surface 54. With such a configuration, it may be difficult to insert the seal elements 28 into the cavities 94 during bladed rotor assembly, particularly where the seal element 28 and any one or more of its element tabs 98 slide along the distal lug ends 50 and its end surfaces 52 and 54.

Figure 7:
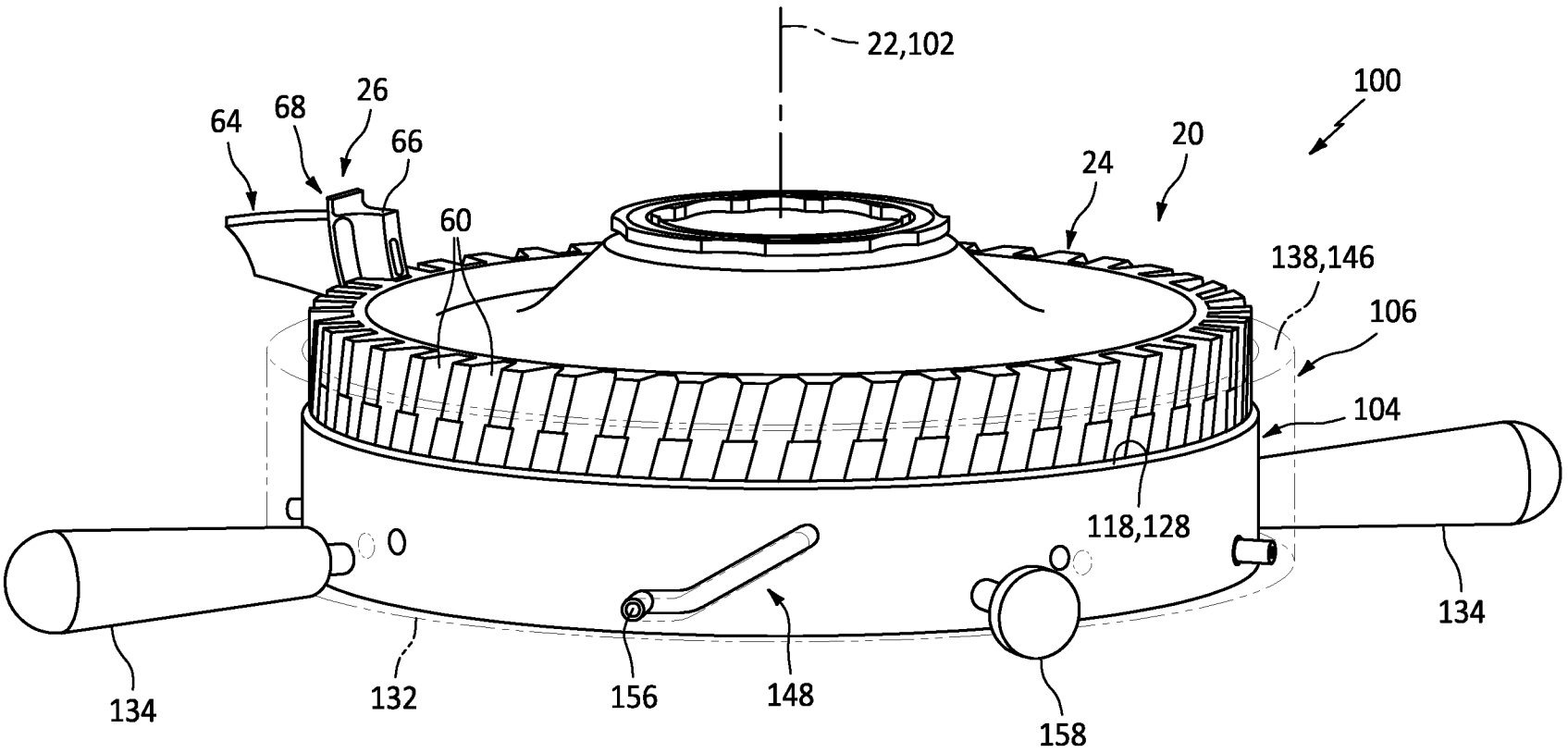
FIG. 7 is a perspective illustration of a fixture for assembling a bladed rotor, where the bladed rotor is shown with a single rotor blade for ease of illustration, and where a blade support structure of the assembly fixture is depicted as semi-transparent.

FIG. 7 illustrates a fixture 100 for use in assembling a bladed rotor such as, but not limited to, the bladed rotor 20 (shown in disassembled form and with one rotor blade 26 in FIG. 7 for ease of illustration). This assembly fixture 100 has a centerline axis 102, which centerline axis 102 may be coaxial with the rotational axis 22 during assembly of the bladed rotor 20. The centerline axis 102 of FIG. 7 is arranged vertically with respect to gravity for assembly of the bladed rotor 20 such that the centerline axis 102 is perpendicular to a horizon line. The assembly fixture 100 of FIG. 7 includes a stationary disk support structure 104 and a movable blade support structure 106.

Figure 8:
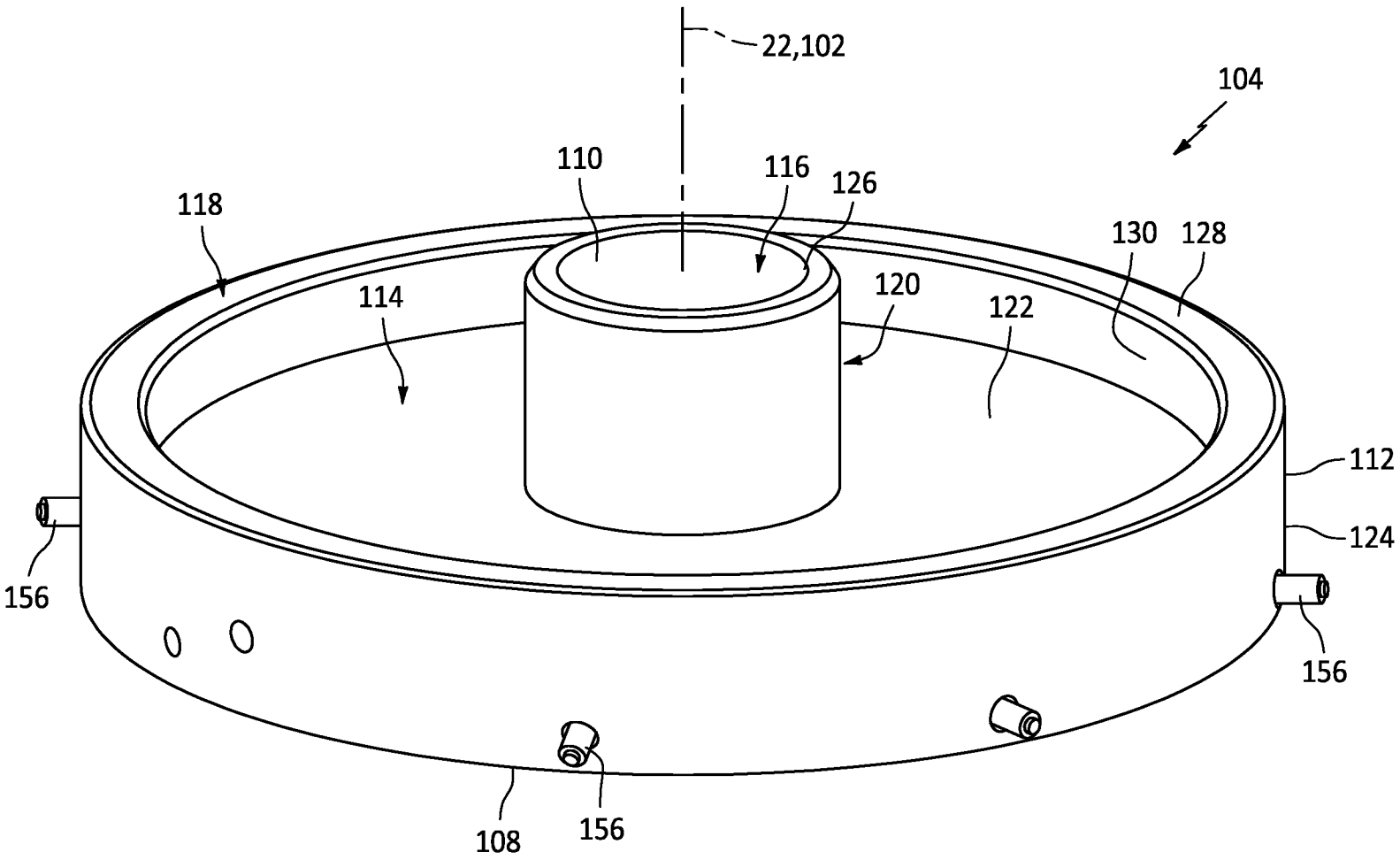
FIG. 8 is a perspective illustration of a disk support structure for the assembly fixture.

Referring to FIG. 8, the disk support structure 104 extends axially along the axis 22, 102 between and to an axial bottom side 108 of the disk support structure 104 and an axial top side 110 of the disk support structure 104. The disk support structure 104 extends radially out from the axis 22, 102 to a radial outer side 112 of the disk support structure 104. The disk support structure 104 extends circumferentially around the axis 22, 102 providing the disk support structure 104 with a full-hoop body. The disk support structure 104 includes a structure base 114, a radial locator 116 and an axial locator 118. The disk support structure 104 may also include a (e.g., removable) bushing 120 (e.g., a spacer, an adaptor, etc.) mounted on the radial locator 116.

The structure base 114 is disposed at the structure bottom side 108. The structure base 114, for example, extends axially along the axis 22, 102 from the structure bottom side 108 to a planar, annular top surface 122 of the structure base 114. The structure base 114 projects radially out from the axis 22, 102 to a cylindrical outer surface 124 of the disk support structure 104 at the structure outer side 112.

The radial locator 116 is connected to (e.g., formed integral with) the structure base 114 and disposed at the structure top side 110. The radial locator 116, for example, projects axially along the axis 22, 102 out from the structure base 114 to the structure top side 110. The radial locator 116 projects radially out from the axis 22, 102 to a cylindrical outer surface 126 of the radial locator 116, which surface 126 is covered by the bushing 120 in FIG. 8. The radial locator outer surface 126 extends axially from the structure base top surface 122 to the structure top side 110.

The axial locator 118 is connected to (e.g., formed integral with) the structure base 114 and disposed at (or towards) the structure top side 110. The axial locator 118, for example, projects axially along the axis 22, 102 out from the structure base 114 to an annular, planar top surface 128 of the axial locator 118. The axial locator top surface 128 may be axially recessed inward from the structure top side 110 by an axial distance such that an axial height of the radial locator 116 is greater than an axial height of the axial locator 118; however, the present disclosure is not limited to such an exemplary dimensional relationship. The axial locator 118 extends radially between and to a cylindrical inner surface 130 of the axial locator 118 and the structure outer surface 124. The axial locator inner surface 130 extends axially from the structure base top surface 122 to the axial locator top surface 128. The axial locator top surface 128 extends radially between and to the axial locator inner surface 130 and the structure outer surface 124.

Figure 9:
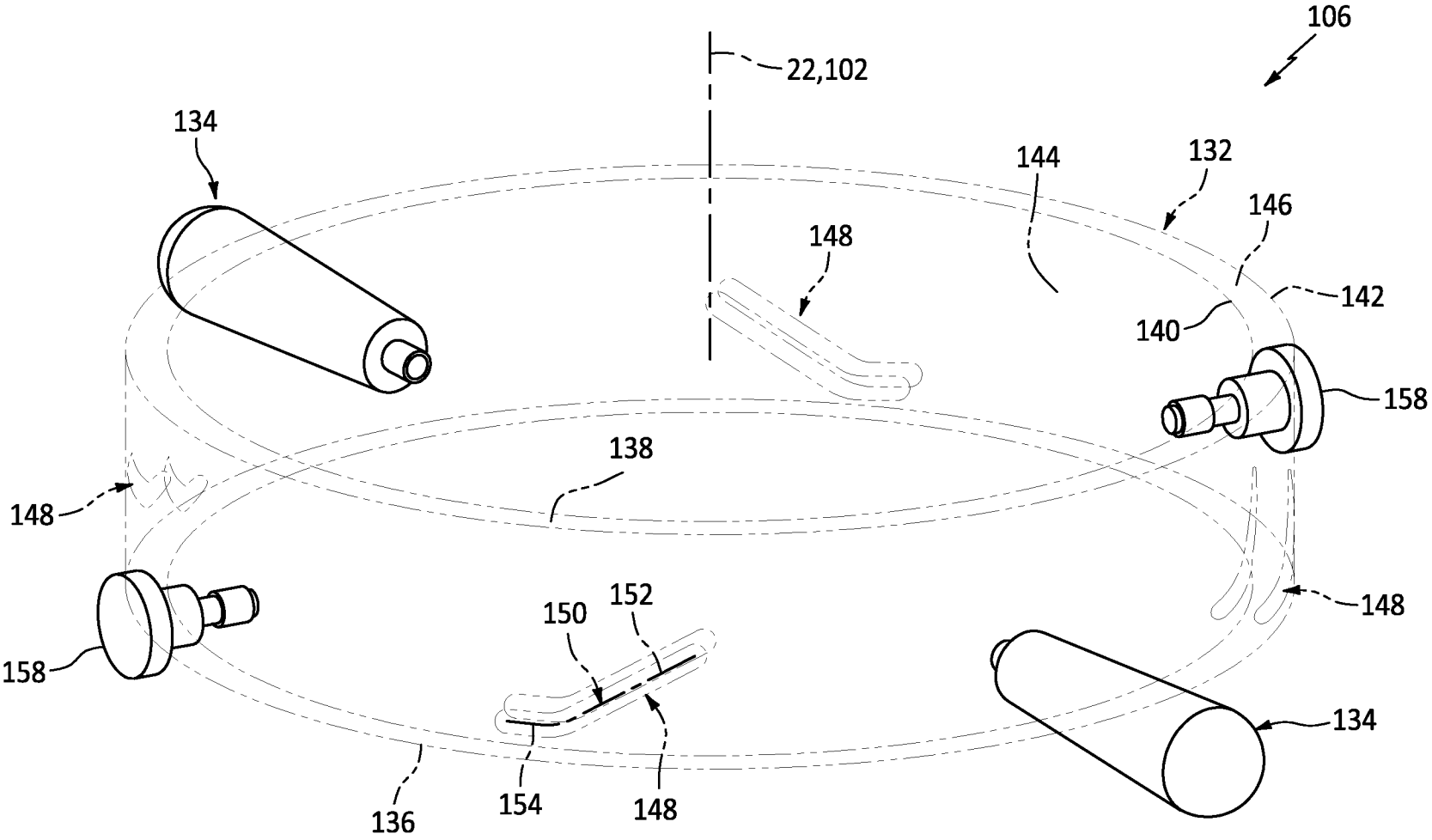
FIG. 9 is a perspective illustration of the blade support structure shown in semi-transparent form.

Referring to FIG. 9, the blade support structure 106 includes a tubular sidewall 132 and one or more handles 134. The structure sidewall 132 extends axially along the axis 22, 102 between and to an axial bottom side 136 of the blade support structure 106 and an axial top side 138 of the blade support structure 106. The structure sidewall 132 extends radially between and to a radial inner side 140 of the blade support structure 106 and a radial outer side 142 of the structure sidewall 132. The structure sidewall 132 extends circumferentially around the axis 22, 102 providing the structure sidewall 132 with a tubular body.

Figure 13:
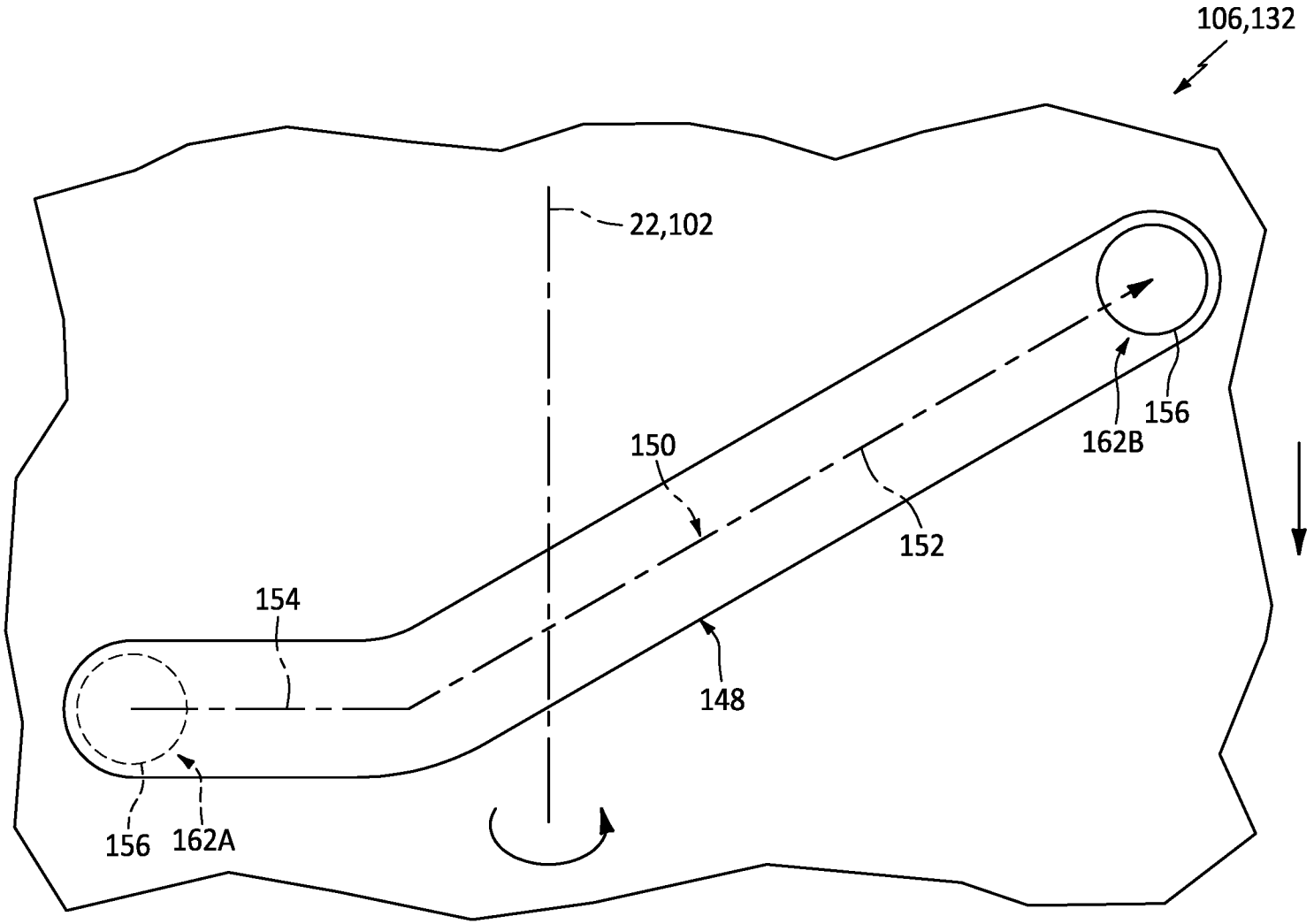
FIG. 13 is a partial side illustration of the blade support structure at a slot, where a guide has moved from a first (dashed line) position to a second (solid line) position.

The structure sidewall 132 of FIG. 9 has a cylindrical inner surface 144 at the structure inner side 140 and an annular, planar top surface 146 at the structure top side 138. The structure sidewall 132 also includes one or more slots 148 (e.g., guide tracks) arranged circumferentially about the axis 22, 102. Each of the slots 148 extends radially through the structure sidewall 132 between the structure inner side 140 and the sidewall outer side 142. Each of the slots 148 of FIG. 9 extends longitudinally within the structure sidewall 132 along a longitudinal trajectory 150 (e.g., centerline) of the respective slot 148; see also FIG. 13. A first (e.g., top) section 152 of the longitudinal trajectory 150 (e.g., only) has an axial component and a circumferential component, where the circumferential component is greater than the axial component. A second (e.g., bottom) section 154 of the longitudinal trajectory 150 (e.g., only) has an axial component. An axial length of the second section 154 may be smaller than an axial length of the first section 152.

The handles 134 are disposed on opposing radial sides of the structure sidewall 132. Each of the handles 134 is connected (e.g., mechanically fastened) to the structure sidewall 132. Each of the handles 134 projects radially out from the sidewall outer side 142.

Figure 11:
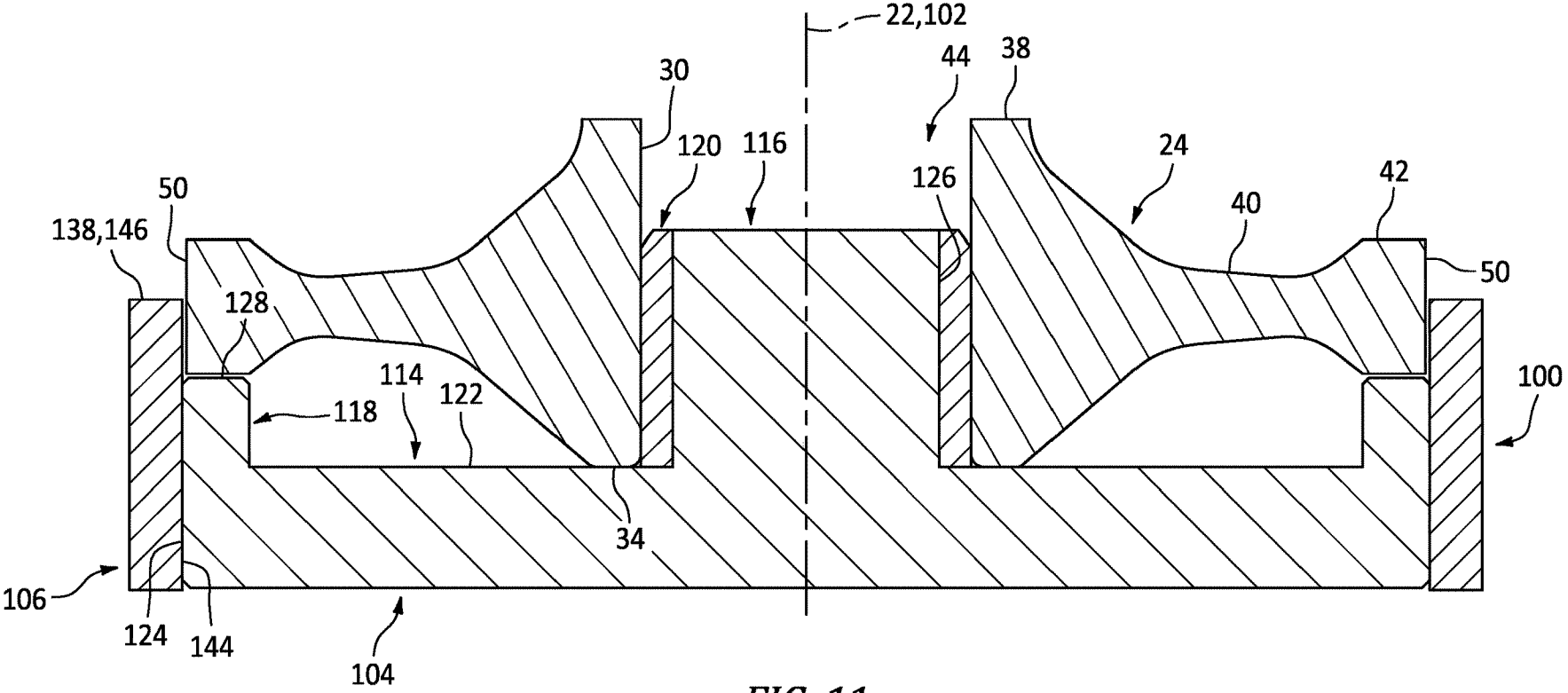
FIG. 11 is a side sectional illustration of the rotor disk arranged with the assembly fixture.

Referring to FIG. 7, the blade support structure 106 is mated with the disk support structure 104. The disk support structure 104, for example, is inserted axially into a bore of the blade support structure 106. The blade support structure 106 and its structure sidewall 132 thereby circumscribe the disk support structure 104. The sidewall inner surface 144 (see FIG. 9) radially engages (e.g., contacts) and is moveable against (e.g., slidable along) the structure outer surface 124 (see FIG. 8); see also FIG. 11. A plurality of guides 156 (e.g., posts, fasteners, pins, etc.) are attached to the disk support structure 104; see also FIG. 8. Each of these guides 156 projects radially out from the structure outer surface 124 (see FIG. 8) into a respective one of the slots 148. One or more locks 158 (e.g., fastener, threaded knobs, plungers, etc.) may be provided, where each lock 158 is configured to rotationally fix the blade support structure 106 to the disk support structure 104. A post of each lock 158, for example, may extend through a lock aperture in the structure sidewall 132 and project into a threaded aperture in the disk support structure 104. However, these locks 158 may be removed (e.g., pulled out, etc.) for seating the blade attachments 66 into the retaining slots 60, for example, as described below.

Figure 10:
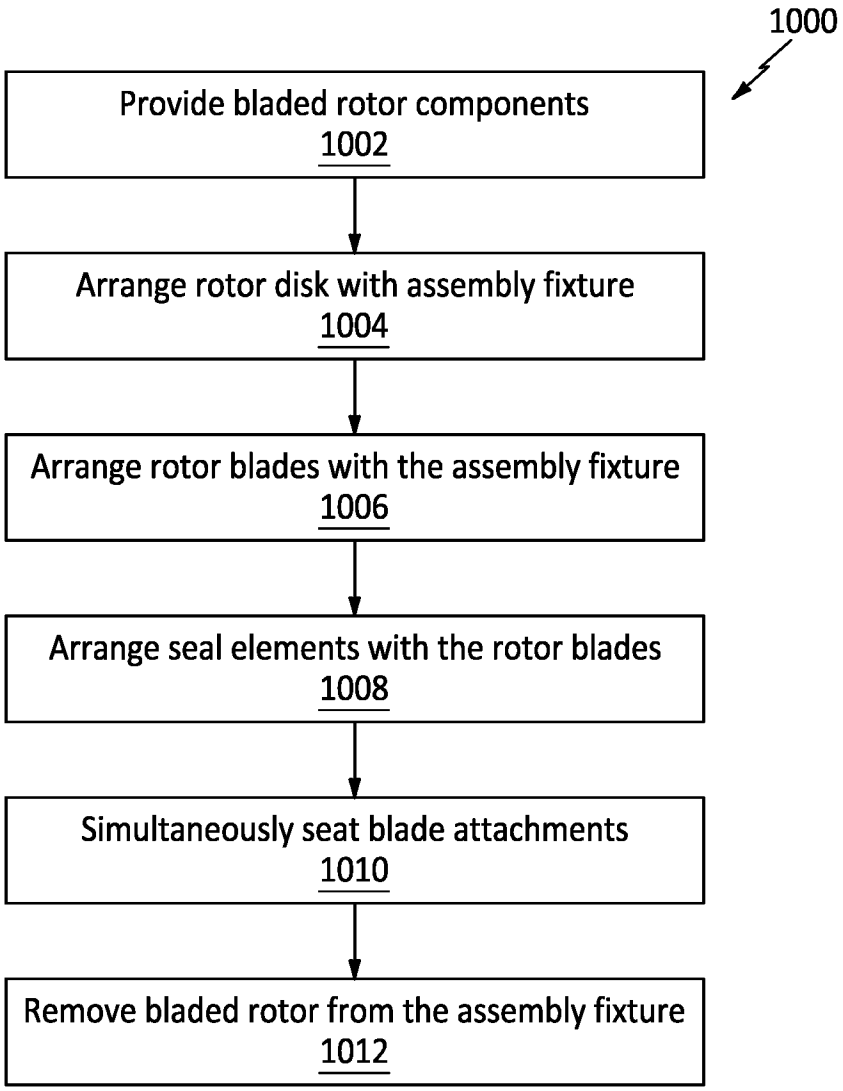
FIG. 10 is a flow diagram of a method for assembling a bladed rotor.

FIG. 10 is a flow diagram of a method 1000 for assembling a bladed rotor using an assembly fixture. For ease of description, the assembly method 1000 of FIG. 10 is described with respect to the bladed rotor 20 and the assembly fixture 100. The assembly method 1000 of the present disclosure, however, is not limited to assembling such an exemplary bladed rotor and/or using such an exemplary assembly fixture.

In step 1002, components of the bladed rotor 20 to be assembled are provided. These rotor components include, but are not limited to, the rotor disk 24, the rotor blades 26 and the seal elements 28.

In step 1004, the rotor disk 24 is arranged with the assembly fixture 100. For example, referring to FIG. 11, the rotor disk 24 is disposed on top of the disk support structure 104. The radial locator 116 may project axially into the disk bore 44. The radial locator outer surface 126 may radially engage the disk hub 38 (e.g., directly/contact, or indirectly through the bushing 120). The radial locator 116 may thereby radially locate the rotor disk 24 on the disk support structure 104. The disk hub 38 may axially engage (e.g., contact) the structure base top surface 122, and the disk rim 42 may axially engage (e.g., contact) the axial locator top surface 128. The top surface(s) 122 and/or 128 may thereby axially locate the rotor disk 24 with the disk support structure 104.

Figure 12:
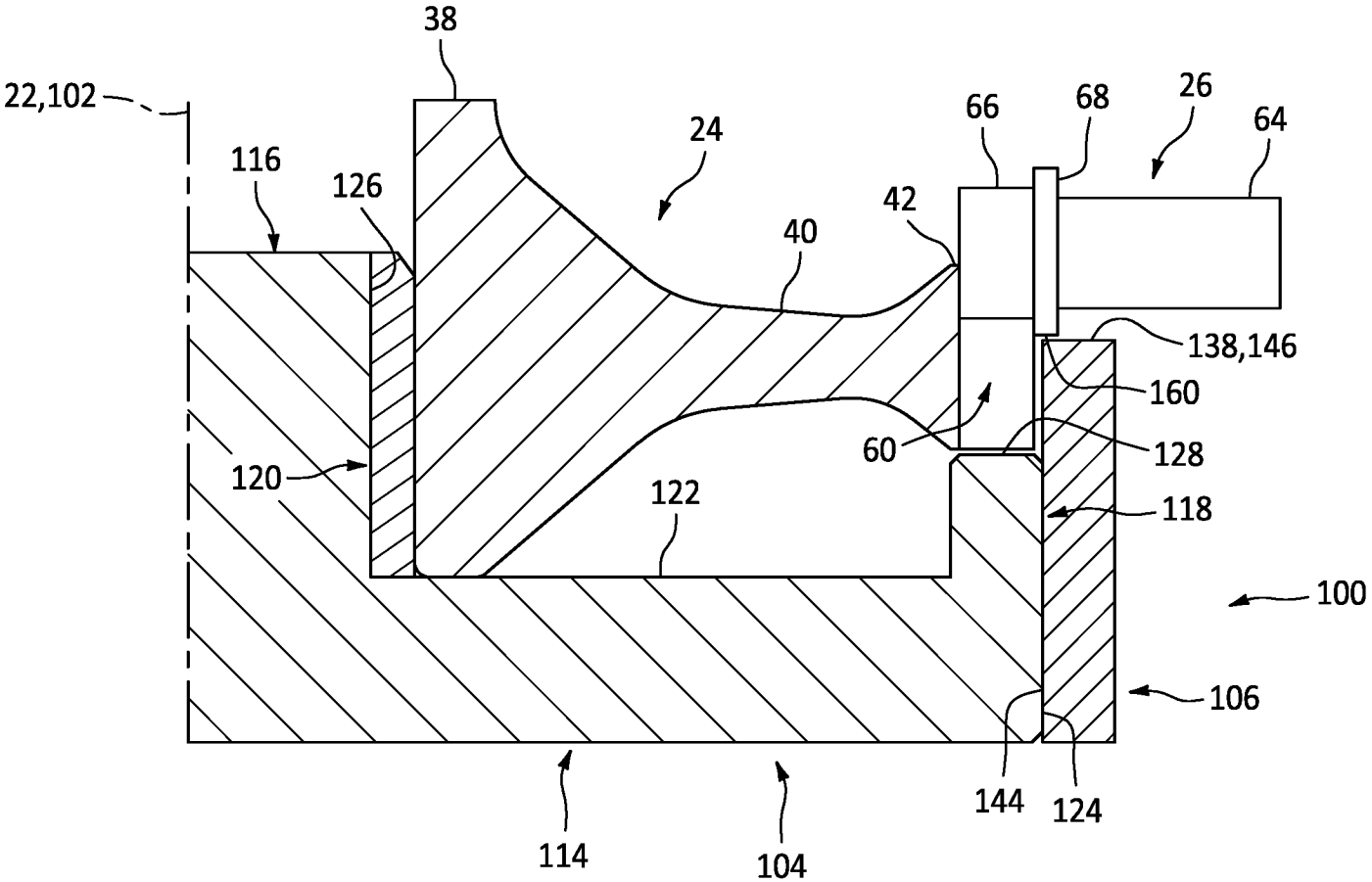
FIG. 12 is a partial side sectional illustration of the rotor disk and each rotor blade arranged with the assembly fixture.

In step 1006, the rotor blades 26 are arranged with the assembly fixture 100. For example, while the blade support structure 106 is in a first (e.g., raised) position of FIG. 12 (see also FIG. 7), each of the blade attachments 66 is inserted vertically downward relative to gravity (e.g., axially along the axis 22, 102) partially into a respective one of the retaining slots 60. At this partially inserted position, an axial (e.g., leading) edge 160 of each of the blade platforms 68 axially engages (e.g., contacts) and rests on top of the top surface 146. All of the blade platforms 68 and, thus, all of the rotor blades 26 may thereby be located at a common axial position along the axis 22, 102 and the axial edges 160 of the blade platforms 68 may define a horizontal reference plane perpendicular to the axis 22, 102; e.g., the plane of the top surface 146.

In step 1008, the seal elements 28 are arranged with the rotor blades 26. For example, referring to FIG. 3, each of the seal elements 28 is inserted into a respective one of the seal element cavities 94. Within the cavity 94, the geometries of the pockets 90 and 92 and/or the geometry of the respective seal element 28 may allow at least a portion of that seal element 28 to lean radially outward towards (e.g., against) the respective blade platforms 68 while the rotor disk 24 is in its horizontal position on the disk support structure 104.

In step 1010, the blade attachments 66 are simultaneously seated in the retaining slots 60. For example, referring to FIG. 13, the blade support structure 106 may be rotated about the axis 22, 102 (relative to the disk support structure 104 of FIG. 2) such that each guide 156 moves within the respective slot 148 from a first (e.g., bottom) position 162A to a second (e.g., top) position 162B. The movement of each guide 156 within the respective slot 148 movement the rotational movement of the blade support structure 106 about the axis 22, 102 into axial translation of the blade support structure 106 in a vertically downward direction along the axis 22, 102 and the rotor disk 24. This vertical downward movement of the blade support structure 106 facilitates controlled vertical downward movement of the blade attachments 66 into the retaining slots 60 until each of the blade attachments 66 is (e.g., completely) seated within its respective retaining slot 60; e.g., see FIG. 4. Note, while the vertical downward movement of the blade support structure 106 controls the vertical downward movement of the rotor blades 26 and their blade attachments 66, the rotor blades 26 may (e.g., only) be pushed vertically downward by a force of gravity.

In step 1012, the bladed rotor 20 and its components 24, 26 and 28 are removed from the assembly fixture 100. The bladed rotor 20, for example, may be lifted vertically off of the assembly fixture 100 for subsequent assembly steps and/or installation within the gas turbine engine.

While the assembly method 1000 is described with respect to assembling the rotor blades 26 and the seal elements 28 with the rotor disk 24, it is contemplated this assembly method 1000 may also be used to assemble rotor blades with a rotor disk without also simultaneously installing the seal elements 28.

In some embodiments, the bladed rotor 20 may be configured as a turbine rotor for a turbine section of the gas turbine engine. However, in other embodiments, the bladed rotor 20 may be configured as a compressor rotor for a compressor section of the gas turbine engine. In still other embodiments, the bladed rotor 20 may be configured as a fan rotor for a fan section of the gas turbine engine.

Figure 14:
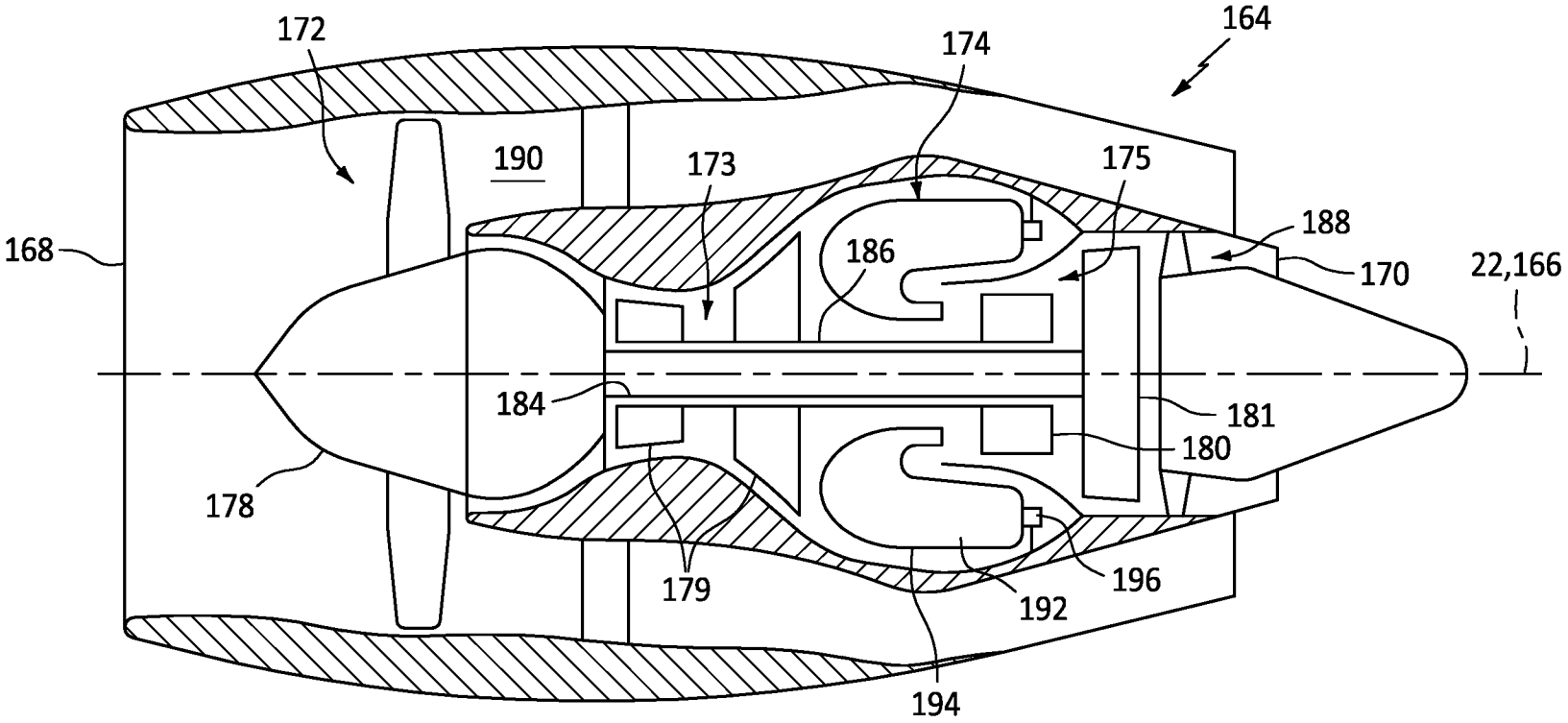
FIG. 14 is a side sectional schematic illustration of a gas turbine engine with which the bladed rotor may be arranged.

FIG. 14 illustrates an example of the gas turbine engine which may include the bladed rotor 20 described above. This gas turbine engine of FIG. 14 is configured as a turbofan gas turbine engine 164. The gas turbine engine 164 of FIG. 14 extends along an axial centerline 166 of the gas turbine engine 164 between an upstream airflow inlet 168 and a downstream airflow exhaust 170, which axial centerline 166 may be parallel with (e.g., coaxial with) the axis 22. The gas turbine engine 164 includes a fan section 172, a compressor section 173, a combustor section 174 and a turbine section 175.

The fan section 172 includes a fan rotor 178. The compressor section 173 includes a compressor rotor 179. The turbine section 175 includes a high pressure turbine (HPT) rotor 180 and a low pressure turbine (LPT) rotor 181, where the LPT rotor 181 is configured as a power turbine rotor. Each of these rotors 178-181 includes a plurality of rotor blades arranged circumferentially around and connected to one or more respective rotor disks. Any one of these rotors 178-181 may be configured as or otherwise include the bladed rotor 20.

The fan rotor 178 is connected to the LPT rotor 181 through a low speed shaft 184. The compressor rotor 179 is connected to the HPT rotor 180 through a high speed shaft 186. The low speed shaft 184 extends through a bore of the high speed shaft 186 between the fan rotor 178 and the LPT rotor 181.

During operation, air enters the gas turbine engine 164 through the airflow inlet 168. This air is directed through the fan section 172 and into a core flowpath 188 and a bypass flowpath 190. The core flowpath 188 extends sequentially through the engine sections 173-175; e.g., a core of the gas turbine engine 164. The air within the core flowpath 188 may be referred to as "core air". The bypass flowpath 190 extends through a bypass duct, which bypasses the engine core. The air within the bypass flowpath 190 may be referred to as "bypass air".

The core air is compressed by the compressor rotor 179 and directed into a (e.g., annular) combustion chamber 192 of a (e.g., annular) combustor 194 in the combustor section 174. Fuel is injected into the combustion chamber 192 via one or more of the fuel injectors 196 and mixed with the compressed core air to provide a fuel-air mixture. This fuel-air mixture is ignited and combustion products thereof flow through and sequentially cause the HPT rotor 180 and the LPT rotor 181 to rotate. The rotation of the HPT rotor 180 drives rotation of the compressor rotor 179 and, thus, compression of air received from an inlet into the core flowpath 188. The rotation of the LPT rotor 181 drives rotation of the fan rotor 178, which propels bypass air through and out of the bypass flowpath 190. The propulsion of the bypass air may account for a significant portion (e.g., a majority) of thrust generated by the turbine engine.

The bladed rotor 20 may be configured with various gas turbine engines other than the one described above. The bladed rotor 20, for example, may be configured with a geared gas turbine engine where a geartrain connects one or more shafts to one or more rotors in a fan section, a compressor section and/or any other engine section. Alternatively, the bladed rotor 20 may be configured with a gas turbine engine configured without a geartrain. The bladed rotor 20 may be configured with a geared or non-geared gas turbine engine configured with a single spool, with two spools (e.g., see FIG. 14), or with more than two spools. The gas turbine engine may be configured as a turbofan engine, a turbojet engine, a turboprop engine, a turboshaft engine, a propfan engine, a pusher fan engine or any other type of gas turbine engine. The gas turbine engine may alternatively be configured as an auxiliary power unit (APU) or an industrial gas turbine engine. The present disclosure therefore is not limited to any particular types or configurations of gas turbine engines.

While various embodiments of the present disclosure have been described, it will be apparent to those of ordinary skill in the art that many more embodiments and implementations are possible within the scope of the disclosure. For example, the present disclosure as described herein includes several aspects and embodiments that include particular features. Although these features may be described individually, it is within the scope of the present disclosure that some or all of these features may be combined with any one of the aspects and remain within the scope of the disclosure. Accordingly, the present disclosure is not to be restricted except in light of the attached claims and their equivalents.

What is claimed is:

1. A method for assembling a rotor of a gas turbine engine, comprising:

providing a rotor disk that comprises an axis and a plurality of slots arranged circumferentially about the axis in an array;

providing a plurality of rotor blades that include a plurality of airfoils and a plurality of attachments, each of the plurality of rotor blades including a respective one of the plurality of airfoils and a respective one of the plurality of attachments;

inserting each of the plurality of attachments partially into a respective one of the plurality of slots;

resting the plurality of rotor blades on top of a blade support structure;

lowering the blade support structure axially downward along the rotor disk to simultaneously seat the plurality of attachments into the plurality of slots; and rotating the blade support structure about the axis while the blade support structure is lowered axially downward along the rotor disk.

2. The method of claim 1, wherein gravity maintains the plurality of rotor blades resting on top of the blade support structure as the blade support structure is lowered axially downward along the rotor disk.

3. The method of claim 1, further comprising:

providing a plurality of seal elements; and inserting each of the plurality of seal elements into a respective cavity formed by and between a respective circumferentially neighboring pair of the plurality of rotor blades.

4. The method of claim 3, wherein each of the plurality of seal elements is inserted into the respective cavity prior to the lowering of the blade support structure.

5. The method of claim 4, wherein each of the plurality of seal elements is inserted into the respective cavity subsequent to the inserting of each of the plurality of attachments partially into the respective one of the plurality of slots.

6. The method of claim 3, wherein the plurality of seal elements comprise a first seal element; and the first seal element includes a base and a plurality of tabs connected to and projecting out from the base.

7. The method of claim 6, wherein each of the plurality of tabs projects radially inward from the base to a distal tab end.

8. The method of claim 6, wherein the rotor disk further comprises a plurality of lugs;

each of the plurality of slots is formed by and between a respective circumferentially neighboring pair of the plurality of lugs;

a first of the plurality of lugs projects radially outward to a distal lug end including a first end surface and a second end surface recessed radially inward from the first end surface; and subsequent to the plurality of attachments being simultaneously seated into the plurality of slots, a first of the plurality of tabs is operable to radially engage the first end surface and a second of the plurality of tabs is operable to radially engage the second end surface.

9. The method of claim 1, wherein the plurality of rotor blades are rested on a planar annular surface of the blade support structure.

10. The method of claim 9, wherein the plurality of rotor blades further include a plurality of platforms, and each of the plurality of rotor blades includes a respective one of the plurality of platforms; and the resting of the plurality of rotor blades comprises resting axial edges of the plurality of platforms on top of the planar annular surface.

11. The method of claim 1, wherein the rotor disk comprises a turbine disk of the gas turbine engine; and the plurality of rotor blades comprise a plurality of turbine blades of the gas turbine engine.

12. A method for assembling a rotor of a gas turbine engine, comprising:

providing a rotor disk that comprises an axis and a plurality of slots arranged circumferentially about the axis in an array;

providing a plurality of rotor blades that include a plurality of airfoils and a plurality of attachments, each of the plurality of rotor blades including a respective one of the plurality of airfoils and a respective one of the plurality of attachments;

inserting each of the plurality of attachments partially into a respective one of the plurality of slots;

disposing the rotor disk on top of a disk support structure;

resting the plurality of rotor blades on top of a blade support structure, the blade support structure mated with and circumscribing the disk support structure; and lowering the blade support structure axially downward along the rotor disk to simultaneously seat the plurality of attachments into the plurality of slots.

13. A method for assembling a rotor of a gas turbine engine, comprising:

providing a rotor disk that comprises an axis and a plurality of slots arranged circumferentially about the axis in an array;

providing a plurality of rotor blades that include a plurality of airfoils and a plurality of attachments, each of the plurality of rotor blades including a respective one of the plurality of airfoils and a respective one of the plurality of attachments;

inserting each of the plurality of attachments partially into a respective one of the plurality of slots;

resting the plurality of rotor blades on top of a blade support structure;

lowering the blade support structure axially downward along the rotor disk to simultaneously seat the plurality of attachments into the plurality of slots; and lifting the rotor off of an assembly fixture, the rotor including the rotor disk and the plurality of rotor blades, and the assembly fixture comprising the blade support structure.

14. A method for assembling a rotor of a gas turbine engine, comprising:

providing a rotor disk, a plurality of rotor blades and a plurality of seal elements, the rotor disk comprising an axis and a plurality of slots arranged circumferentially about the axis in an array, the plurality of rotor blades including a plurality of airfoils and a plurality of attachments, and each of the plurality of rotor blades including a respective one of the plurality of airfoils and a respective one of the plurality of attachments;

inserting each of the plurality of attachments partially into a respective one of the plurality of slots;

arranging each of the plurality of seal elements between a respective circumferentially neighboring pair of the plurality of rotor blades; and simultaneously seating the plurality of attachments into the plurality of slots using a force of gravity alone to push the plurality of attachments into the plurality of slots.

15. The method of claim 14, wherein the plurality of rotor blades further include a plurality of platforms, and each of the plurality of rotor blades further includes a respective one of the plurality of platforms; and axial edges of the plurality of platforms define a reference plane while the plurality of attachments are seated into the plurality of slots.

16. The method of claim 15, further comprising resting the axial edges of the plurality of platforms on top of a planar annular surface of a blade support structure as the plurality of attachments are seated into the plurality of slots.

17. A fixture for assembling a rotor of a gas turbine engine, comprising:

a disk support structure configured to support a rotor disk of the rotor during assembly of the rotor, the disk support structure including a base, a radial locator and an axial locator circumscribing the radial locator, the radial locator projecting axially along an axis out from a first side of the base, the radial locator configured to radially locate and engage the rotor disk on the disk support structure, the axial locator projecting axially along the axis out from the first side of the base, and the axial locator configured to axially locate and engage the rotor disk on the disk support structure; and a blade support structure configured to support a plurality of rotor blades of the rotor during the assembly of the rotor, the blade support structure circumscribing and slidable against an outer periphery of the disk support structure, the blade support structure extending axially along the axis to a planar annular surface configured to axially locate and engage the plurality of rotor blades while attachments of the plurality of rotor blades are seated in slots in the rotor disk.

18. The fixture of claim 17, further comprising:

a guide connected to the disk support structure and projecting radially into a slot in the blade support structure;

the slot extending within the blade support structure along a longitudinal trajectory;

a first section of the longitudinal trajectory having an axial component and a circumferential component; and a second section of the longitudinal trajectory having a circumferential component.

19. The fixture of claim 17, further comprising a lock configured to rotatably fix the blade support structure to the disk support structure.

* * * * *